United States Patent [19]

Luborsky

[11] 4,227,120

[45] Oct. 7, 1980

[54] STRESS-RELIEVED AMORPHOUS METAL TOROID-SHAPED MAGNETIC CORE

[75] Inventor: Fred E. Luborsky, Schenectady, N.Y.

[73] Assignee: General Electric Company, Schenectady, N.Y.

[21] Appl. No.: 944,886

[22] Filed: Sep. 22, 1978

[51] Int. Cl.[3] ..... H05B 41/16; H05B 41/24

[52] U.S. Cl. ..... 315/248; 148/108; 148/121; 148/31.55; 336/213; 336/218

[58] Field of Search ..... 148/108, 121, 31.55; 315/248; 336/213, 233, 218

[56] References Cited

U.S. PATENT DOCUMENTS

| | | | |
|---|---|---|---|
| 4,017,764 | 4/1977 | Anderson | 315/57 |
| 4,056,411 | 11/1977 | Chen et al. | 148/108 |
| 4,081,298 | 3/1978 | Mendelsohn et al. | 148/121 |
| 4,116,728 | 9/1978 | Becker et al. | 336/213 |
| 4,126,287 | 11/1978 | Mendelsohn et al. | 148/31.55 |
| 4,144,058 | 3/1979 | Chen et al. | 75/123 |
| 4,152,144 | 5/1979 | Hasegawa et al. | 75/123 K |

*Primary Examiner*—Saxfield Chatmon, Jr.

*Attorney, Agent, or Firm*—Leo I. MaLossi; James C. Davis, Jr.

[57] ABSTRACT

An improved magnetic core of an amorphous metal alloy is provided for electrodeless fluorescent lamps.

9 Claims, 4 Drawing Figures

LOSSES AT VARIOUS FREQUENCIES FOR AS-WOUND AND ANNEALED AMORPHOUS ALLOY TOROIDS. SINE H TEST AT $B_m$ - 1KG SAMPLES ANNEALED TO MINIMUM $H_c$ VALUES.

AS-WOUND ———
ANNEALED - - - -

ϕ $Fe_{25}Ni_{55}B_{19}P_1$ ø $Fe_{37.5}Ni_{42.5}B_{10}Si_{10}$ ⊘ $Fe_{82}B_{18}$
ALL OTHER ALLOYS ARE $(Fe_x Ni_{100-x})_{80} B_{20}$)

"INITIAL" IMPEDANCE PERMEABILITY FOR AS-WOUND AND ANNEALED-AMORPHOUS ALLOY TOROIDS SAMPLES ANNEALED TO MINIMUM $H_C$ VALUES.

POWER LOSS VS MEAS. TEMP. FOR TWO EXPERIMENTAL FERRITES COMPARED TO AMORPHOUS $Fe_{30}Ni_{50}B_{20}$ ALL TAKEN AT 4.4 VOLTS/TURN

STRESS-RELIEVED AMORPHOUS METAL TOROID-SHAPED MAGNETIC CORE

The Government has rights in this invention under Contract No. N00014-76-C-0807 awarded by the Office of Naval Research, Department of the Navy.

BACKGROUND OF THE INVENTION

This invention relates to improved magnetic cores and more particularly to magnetic cores of amorphous metal alloys suitable for use in electrodeless fluorescent lamps.

A group of magnetic, amorphous metal alloys have recently become commercially available. These compositions and methods for producing them are described, for example, in U.S. Pat. No. 3,856,514 to Chen et al., 3,845,805 to Kavesh, and 3,862,658 to Bedell. Such alloys are presently produced on a commercial scale by the Allied Chemical Corp. and are marketed under the Metglas trademark.

Becker et al., U.S. Patent application U.S. Ser. No. 911,976 filed June 2, 1978, have taught the use of amorphous metal alloys for use in magnetic cores, including electrodeless fluorescent lamps, and Liebermann et al., IEEE Trans. Magnetics MAG-12 921 (1976), have suggested that alloys containing only boron as the glass-forming element appear to have advantages over phosphorus containing alloys both in their magnetic quality and their resistance to embrittlement.

BRIEF DESCRIPTION OF THE INVENTION

It has now been discovered that an improved magnetic core comprising a stress-relieved toroid formed from a spirally-wound ribbon of magnetic amorphous metal alloy of the formula $(Fe_xNi_{100-x})_{100-y}R_y$ wherein R is at least one glass former, x is an integer of from 20 to 35 preferably 20–30 and y is an integer of from 15 to 25, can be used as a substitute for the ferrites in an electrodeless fluorescent lamp. Moreover, in addition to having resistance to embrittlement, the alloys of the above formula have both low core losses and high permeabilities. Typical glass formers which can be employed include P, Si, B, C, Ge, Al, S, Se, Sb, Sn and mixtures thereof. Designations of specific compositions are expressed in atom percent.

DETAILED DESCRIPTION OF THE INVENTION

Amorphous metal alloys have recently become commercially available in the form of thin ribbons and wires. These metallic glasses are characterized by an absence of grain boundaries and an absence of long range atomic order. They exhibit a number of unusual properties including corrosion resistance, low sonic attenuation, high strength and low magnetic coercive forces. The alloys are produced by rapidly quenching molten metals, at a rate of approximately $10^{6°}$ C./sec., to develop a glassy structure. Methods and compositions useful in the production of such alloys are described in the above-described United States patents which are incorporated herein, by reference, as background material.

In accordance with the present invention, ribbons of a ferrous amorphous alloy after fabrication to their final shape are heated in a temperature and time cycle which is sufficient to relieve the material of all stresses but which is less than that required to initiate crystallization. The sample may then be either cooled slowly through its Curie temperature, or held at a constant temperature below its Curie temperature in the presence of a magnetic field. The direction of the field during the magnetic anneal may lie in the plane of the ribbon, either parallel or transverse to its length and, by controlling the direction of the field, its strength, and the temperature-time cycle of the anneal, the magnetic properties of the resultant material may be varied to produce a wide range of different and useful characteristics in magnetic circuit elements.

The term "directed magnetic field", as used herein and in the appended claims, includes magnetic fields of zero value and magnetic fields with rapidly changing direction.

EXAMPLES

Figure 2:
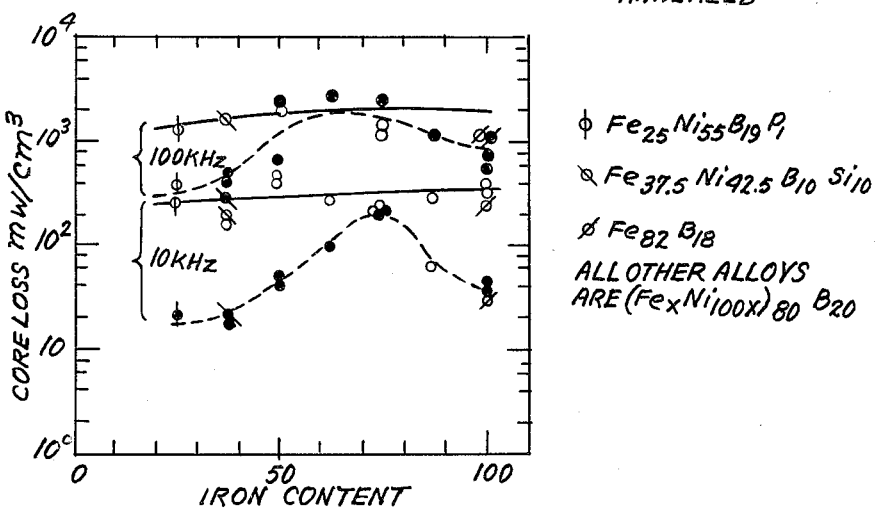
FIG. 2 is a plot of core losses at various frequencies for amorphous alloy toroids.
Figure 3:
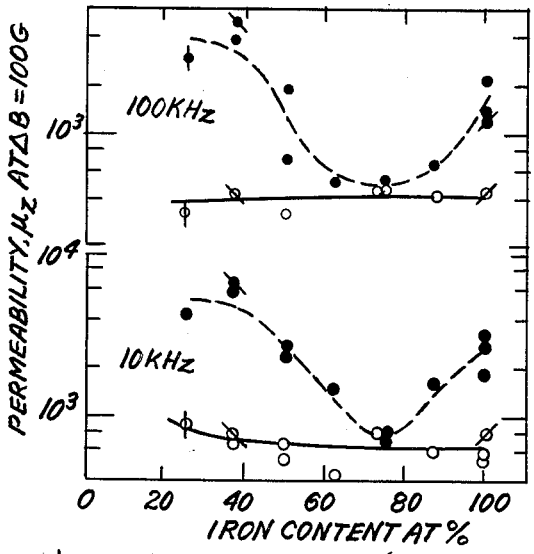
FIG. 3 is a plot of impedance permeability for amorphous alloy toroids.
Figure 4:
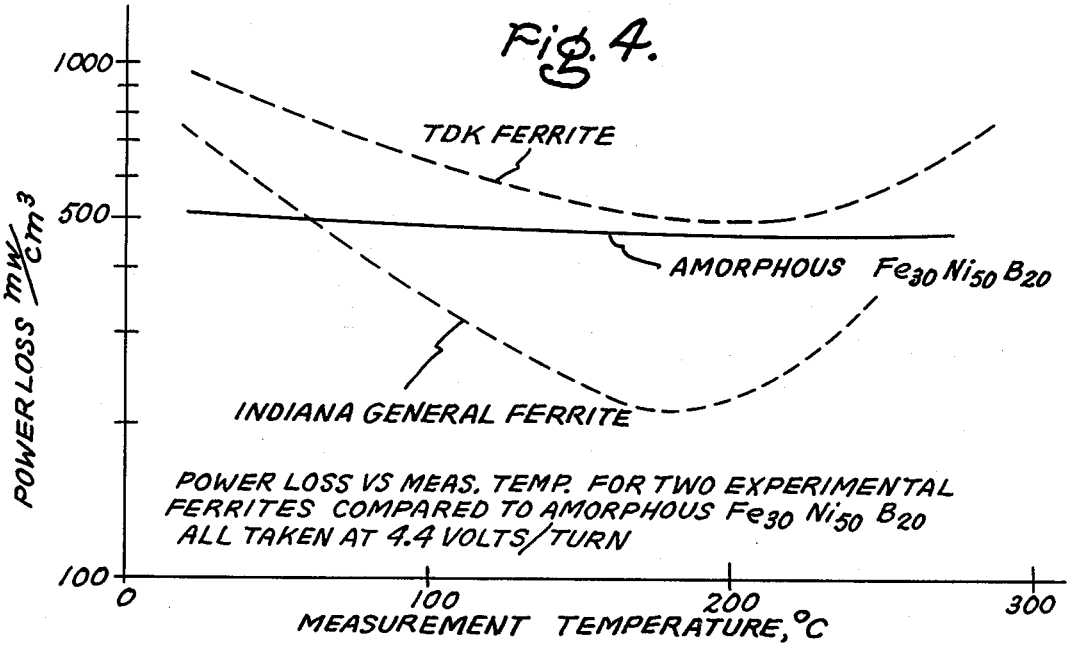

Amorphous alloy ribbons were prepared by directing a molten stream of metal onto the surface of a rotating drum. About 10 to 15 turns of ribbon were then wound into an open aluminum or tungsten core box with an average diameter of 1.4 cm. Fifty turns of wire insulated with high temperature enamel were wound on the box for drive and for sense windings. DC hysteresis loops were obtained using an integrating flux meter. Ac losses and permeabilities were obtained from 100 Hz to 100 kHz as a function of drive field using a sine H drive. To measure losses, a voltampere-phase shift measurement was used where the total losses are $W=VI\cos\theta/v$ where V=rms signal voltage, I=rms drive current, v=sample volume and $\theta$=phase shift. The permeabilities were calculated using $\mu_z=Vl10^8/8fIN^2A$ where l=magnetic path length, f=frequency, N=turns of wire on the core, and A=cross section of magnetic material. After toroidally winding, the samples were then annealed at 25° C. intervals, in a circumferential field, starting at 275° C. and ending at approximately 375° C. Core losses at 1 KG for sine H drive (FIG. 2) and permeability (FIG. 3) are shown as a function of frequency. The core losses of the as-wound ribbons increase with values of x and the permeabilities decrease with values of x. However, after annealing to minimum losses, the losses show a peak at about 75% iron, and the permeability shows a minimum at about the same value. It can be seen that annealed alloys within the invention have both low core losses and high permeability rendering them particularly useful as magnetic cores for electrodeless fluorescent lamps. The power loss of amorphous $Fe_{30}Ni_{50}B_{20}$ is compared to two experimental ferrites in FIG. 4. In addition, the room temperature saturation magnetization is above about 5 kG. In comparison prior art amorphous alloys such as METGLAS 2826 produced by Allied Chemical Corp. and having a nominal composition of $Ni_{40}Fe_{40}P_{14}B_6$ have both higher core losses and lower permeabilities. See, for example, FIGS. 2 and 3 wherein an alloy of the invention having 35% Fe has from 2–2½ times less core loss and higher permeabilities.

The magnetic properties of amorphous alloys are extremely stress-sensitive. Thus, the properties of amorphous alloy ribbons, which are annealed in straight form, suffer degradation when wound into toroidal magnetic cores. An amorphous alloy ribbon, however, can also be successfully magnetic-annealed in the form of toroidal samples. When this is done, the magnetic properties are substantially improved over those of toroids wound from annealed straight ribbons.

The remanence-to-saturation ratio of amorphous magnetic alloy ribbons may be increased by annealing in a parallel magnetic field or may be decreased by annealing in a transverse magnetic field. The particular value of the remanence-to-saturation ratio produced by the annealing process may be controlled by varying the process parameters of the magnetic anneal. Toroids with minimum core loss may be produced by heating to achieve stress relief and subsequent annealing to control the magnetically reduced anisotropy. For example, if the Curie temperature is below the stress relief temperature, quenching the sample from above the Curie temperature will produce an intermediate $M_r/M_s$ and, thus, low core losses.

Figure 1:
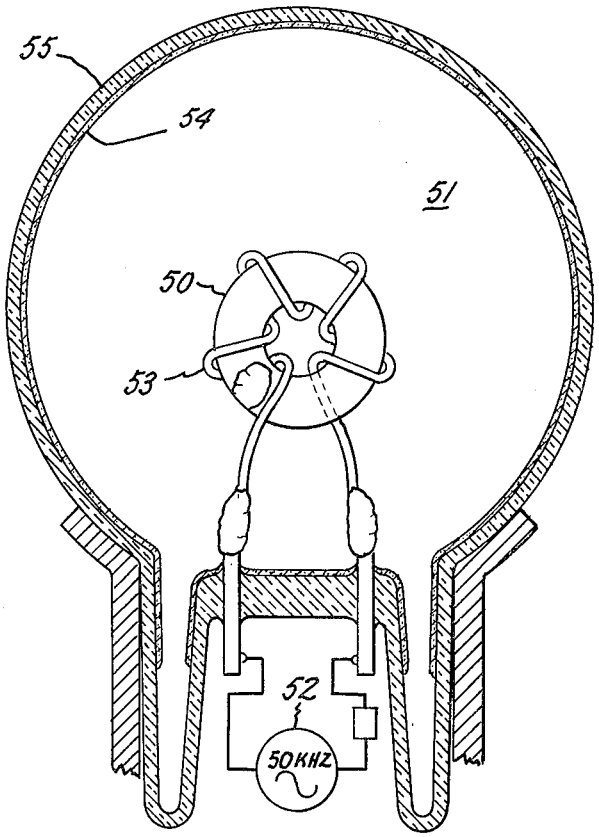
FIG. 1 is an induction ionized fluorescent lamp comprising an amorphous magnetic alloy core.

High permeability, toroidal cores have recently been utilized to couple electrical energy into induction ionized gas discharge lamps. FIG. 1 is such a lamp comprising a toroidal core 50 disposed centrally within an ionizable gaseous medium 51 and driven by a radio frequency current source 52 through a primary winding 53. Current flow in the primary induces an electric discharge in the gaseous medium which produces visible light by ultraviolet stimulation of a phosphor 54 on the inner surface of a substantially globular, light transmissive glass envelope 55, in a well-known manner. The construction and operation of such lamps is described, for example, in U.S. Pat. No. 4,017,764 issued to John M. Anderson, which is assigned to the assignee of this invention and which is incorporated, by reference, herein as background material. The operation of ferrite cores in such lamps is, however, at times, limited by core losses and by the magnetic characteristics of ferrite wherein the permeability and the saturation flux density decrease substantially at elevated temperatures.

Although ac losses at room temperature in lamp toroids of amorphous alloy ribbon arm somewhat lower than those in the best available ferrites, the losses of ferrites typically decrease with increase in temperature but again increase at higher temperatures as their Curie point is approached. The saturation flux density of amorphous alloy cores is substantially greater and maintains this value at substantially higher temperatures than most ferrites. Furthermore, the losses and permeability of the amorphous alloys are independent of operating temperature in contrast to the ferrites. This results in superior high temperature performance of the amorphous metal toroids.

Improved induction ionized fluorescent lamps containing toroidal cores of amorphous magnetic alloys, in place of conventional ferrite cores, are, therefore, capable of more efficient high temperature operation than are prior art lamps.

While the invention has been described with reference to specific details of particular embodiments, it is not intended to limit the scope of the invention except insofar as the specific details are recited in the appended claims.

I claim:

1. An improved magnetic core comprising a stress-relieved toroid formed from a spirally wound unannealed ribbon of magnetic amorphous metal alloy of the formula: $(Fe_xNi_{100-x})_{100-y}R_y$ wherein R is at least one glass former, x is an integer in the range of from 20 to 35 and y is an integer in the range of from 15 to 25, said toroid being stress-annealed as wound.

2. The core of claim 1 wherein x is an integer in the range of from 20–30.

3. The core of claim 1 wherein x is an integer in the range of from 20–30, y is about 20, and R is selected from the group consisting of B, P, Si and mixtures thereof.

4. In an electrodeless fluorescent lamp means comprising a core; a mass of gaseous medium linking said core and adapted to sustain an electric discharge due to an electric field induced therein by said core and to emit radiation at a first wavelength when sustaining said discharge; a substantially spherical, evacuable light transmissive envelope containing said mass; a luminous phosphor on the surface of said envelope, said phosphor being adapted to emit visible light when excited by said first wavelength radiation; and means for energizing said core with a radio frequency magnetic field whereby said electric field is induced in said mass, the improvement in which said core comprises a stress-relieved toroid formed from a spirally wound unannealed ribbon of magnetic amorphous metal alloy of the formula: $(Fe_xNi_{100-x})_{100-y}R_y$ wherein R is at least one glass former, x is an integer in the range of from 20 to 35 and y is an integer in the range of from 15 to 25, said toroid being stress-annealed as wound.

5. The improvement in electrodeless fluorescent lamps recited in claim 4 wherein the value of x is an integer in the range of from 20 to 30.

6. The improvement in electrodeless fluorescent lamps recited in claim 5 wherein R is selected from the group consisting of B, P, Si and mixtures thereof.

7. A method for manufacturing a magnetic core comprising the steps of:

spirally winding a ribbon of a magnetic amorphous metal alloy of the formula $(Fe_xNi_{100-x})_{100-y}R_y$ wherein R is at least one glass former, x is an integer in the range of from 20 to 35 and y is an integer in the range of from 15 to 25 to form a toroidal body; and heating said toroidal body to a temperature sufficiently elevated to achieve stress relief of said amorphous metal alloy to minimize core losses for that given composition.

8. The method of claim 7 further comprising the step of:

conducting the heating of said toroidal body in the presence of a directed magnetic field.

9. The method of claim 8 wherein said magnetic field is disposed circumferentially with respect to said toroidal body.

* * * * *